US005383622A

United States Patent [19]

Kohler

[11] Patent Number: 5,383,622

[45] Date of Patent: Jan. 24, 1995

[54] WEB TRANSFER MECHANISM AND METHOD FOR A CONTINUOUS WINDER

[75] Inventor: Herbert B. Kohler, Uniontown, Ohio

[73] Assignee: The Kohler Coating Machinery Corporation, Greentown, Ohio

[21] Appl. No.: 57,740

[22] Filed: May 5, 1993

[51] Int. Cl.[6] ..... B65H 19/20

[52] U.S. Cl. ..... 242/527.2

[58] Field of Search ..... 24/52 A, 56 R, 65, 66, 24/64, 527.2

[56] References Cited

U.S. PATENT DOCUMENTS

| | | | |
|---|---|---|---|
| 2,950,873 | 8/1960 | Nelson | 242/56 A |
| 3,066,882 | 12/1962 | Havens et al. | 242/56 A |
| 3,086,725 | 4/1963 | Zernov | 242/56 A |
| 3,592,403 | 7/1971 | Schmitt et al. | 242/56 A |
| 3,796,388 | 3/1974 | Davis | 242/56 A |
| 3,848,824 | 11/1974 | Van Schijndel | 242/56 A |
| 3,889,892 | 6/1975 | Melead | 242/56 R |
| 3,930,620 | 1/1976 | Taitel | 242/56 A |
| 4,056,918 | 11/1977 | Matsumoto | 242/56 A X |
| 4,058,267 | 11/1977 | Schüttler | 242/56 A |
| 4,326,679 | 4/1982 | Phelps et al. | 242/56 A |
| 4,326,680 | 4/1982 | Tetro et al. | 242/56 A |
| 4,422,586 | 12/1983 | Tetro | 242/56 R |
| 4,458,852 | 7/1984 | Calvert et al. | 242/56 A |
| 4,529,141 | 7/1985 | McClenathan | 242/56 A |
| 4,609,162 | 9/1986 | Kataoka | 242/56 R |
| 4,678,133 | 7/1987 | Suzuki | 242/56 A |
| 4,715,552 | 12/1987 | Matsumoto | 242/56 A |
| 4,770,358 | 9/1988 | Suzuki et al. | 242/56 A |
| 4,919,352 | 4/1990 | Terp et al. | 242/56 A |

FOREIGN PATENT DOCUMENTS

| | | | |
|---|---|---|---|
| 2730080 | 1/1979 | Germany | 242/56 A |
| 3629216 | 3/1988 | Germany | 242/55 |
| 3629217 | 3/1988 | Germany | 242/55 |
| 53-76566 | 1/1980 | Japan | 242/56 A |
| 57-141344 | 9/1982 | Japan | 242/56 R |
| 58-224957 | 12/1983 | Japan | 242/56 R |

*Primary Examiner*—Daniel P. Stodola
*Assistant Examiner*—John P. Darling
*Attorney, Agent, or Firm*—Pearne, Gordon McCoy & Granger

[57] ABSTRACT

A continuous web winder is provided with an improved web cutter and transfer mechanism to wind the web on a new core. The moving web is positioned near the core between a blade and a web deflector. The web is deflected into the blade to cleanly cut the web and urge it toward the core. An air current is induced in a channel between the core and a hood to evacuate air from under the web and pull the web toward the core. The core can be provided with a low tack adhesive to ensure adherence of the web on the core. The web winds without folding back on itself to form a smooth roll.

22 Claims, 3 Drawing Sheets

WEB TRANSFER MECHANISM AND METHOD FOR A CONTINUOUS WINDER

BACKGROUND OF THE INVENTION

1. Field of the Invention

This invention relates generally to web winders and rewinders and specifically to an improved web cutting and transfer mechanism for turret-type web winders.

2. Description of Related Art

In the processing of materials such as paper, film, foil, and the like, a web of the material is often provided from a series of supply rolls. The web is unwound from the rolls, processed, and rewound to form several finished rolls. The rewinder is preferably constructed to maintain continuous, uninterrupted winding of the new rolls. A series of rollers are arranged to move the web to desired processing locations and guide the web to a core on which it is rewound.

The rewinder includes a cutoff and transfer mechanism for automatically cutting the web and transferring the web from the end of a full roll to a new core to form the next roll. Many arrangements are known for indexing the rolls and positioning the web so that the web can be transferred to a new core and a full roll can be removed without interrupting the rewinding. Typically, cores on which the rolls are formed are mounted on a rotatable turret. The turret is rotated to position a new core adjacent a transfer mechanism. Transfer mechanisms typically include a serrated blade which is driven into the web. Other mechanisms provide a means to move the web into the blade to cut the web. In either case, the leading edge of the cut web is guided onto the new core to begin a new roll. An adhesive, such as tape, is often provided on the core to secure the leading edge.

Preferably, the leading edge of the web is placed on the core in a smooth and even fashion. Thus, the leading edge should be cut smoothly and should not fold back on itself. If an adhesive is used on the core, it should not form a lump in the roll. Because the cores are often reused many times, the cores should not be damaged by the rewinding, and residue from the adhesive should not be left on the cores.

Winders which transfer the web onto the new core by deflecting the web into a stationary blade have been described in several patents.

U.S. Pat. No. 3,086,725 to Zernov shows a turret winder having a blade on movable, elongated arms located near a new core on which a web is to be wound. The core is provided with adhesive such as an adhesive tape. A presser roller and a guide bar are located on the opposite side of the web from the blade. A pair of arms move the guide bar and roller into the blade to cut the web and press the web onto the core.

U.S. Pat. No. 4,326,680 to Tetro et al shows a winder having a blade on a movable arm. A curved guide conforming to a new core forms a part of the arm holding the blade. Prior to cutting, the web is moved into position against the core by an enveloper roller on movable arms. A movable deflector is mounted on the arms with the enveloper roller. The deflector is moved into the web to cut the web on the blade. The guide physically guides the leading edge of the web around the core.

U.S. Pat. No. 4,326,679 to Phelps et al shows a winder having a blade on a movable arm. A curved guide conforming to a new core forms a part of the arm holding the blade. Prior to cutting, the web is moved into position against the core by a pressure roller on movable arms. A movable deflector including a curved guide is mounted on another set of movable arms. The deflector is moved into the web to cut the web on the blade. The guides physically guide the leading edge of the web around the core.

Instead of using a deflector, U.S. Pat. No. 4,422,586 to Tetro uses a pressure roller to press the web against the new core prior to cutting. The core is provided with an adhesive so that the web is pulled into a blade by the core. It is suggested that a brush or an air jet could be used instead of the pressure roller. As can be seen in Tetro '586 the blade will tend to peel the web from the core, especially at high speeds, thus, the adhesive must be very strong. The adhesive typically used has an adhesion to steel on the order of 45 lbs./in., such as 3M Company's No. 910 splicing tape. Peeling and bending of the web may cause it to slide over the blade thereby making a rough cut which causes an uneven application to the core and creates dust from the web and its coating. To ensure sufficient bonding with the web and efficient cutting, the knife must be positioned close to the core, therefore the core cannot be eccentric. When the web is relatively thick, it may be pulled from the core before it is cut by the blade.

Several patents show winders in which a blade is moved into the web and an air jet is used to push the web onto the core. U.S. Pat. No. 4,919,352 to Terp et al shows an air jet emanating from an elongated arm. U.S. Pat. No. 4,529,141 to McClenathan shows the air emanating from part of a vacuum type roller. U.S. Pat. No. 3,592,403 to Schmitt et al shows air emanating from a pressure roller. In each of these references the air is directed toward the core at an angle to push the web onto the core. U.S. Pat. No. 3,889,892 to Melead merely suggests that an air jet could be used. It has been found that, because a blade assembly is relatively bulky and must be moved quickly, it is preferable for the blade to remain stationary during cutting. Moreover, air jets directed at the web can have the undesirable effect of pulling the web away from the core according to the Bernoulli Principle. The faster moving air from the air jet has a lower lateral pressure than the stationary air between the web and core.

In all of the prior art references, air between the web and the core tends to inhibit motion of the web toward the core. In addition, the flexible web is pushed onto the new core with an air jet or merely by the continuing motion of the web. When pushing a flexible member, it is difficult to control the leading edge, thus, as shown in some of the references, a mechanical guide is used. However, such a guide creates friction with the web and may cause the web to fold back on itself or may damage the leading edge thereby creating dust.

Accordingly, it would be desirable to have an improved web transfer mechanism in which the blade is stationary when the web is cut. The web should be cut cleanly without creating dust or a ragged edge. The web should be pulled onto the core without the friction incident to a mechanical guide. The mechanism should urge the web onto the new core and evacuate air from between the web and the core. The web should lay on the core without folding back or having a lump of adhesive tape.

SUMMARY OF THE INVENTION

The present invention provides a web transfer apparatus for a web winder including a rotatable core for winding a web thereon. A means for positioning the web near the core is provided. A cutter blade is positionable near the web and near the core. A web deflector is positionable near the web on the opposite side from the cutter blade for deflecting the web toward the core and into engagement with the cutter blade thereby cutting the web. A hood is located adjacent the cutting means and spaced from the core, and a channel is defined by the core and the hood. An air jet is provided to induce an air current in the channel over the web end and core to pull the leading edge of the web through the channel and onto the core.

Preferably, the air jet is positioned downstream from the channel to direct air tangentially to the core and away from the channel. The air jet creates an air stream having a greater velocity than the leading edge of the web to pull and straighten the cut edge of the web as it passes through the channel without contacting the hood. The cutting means, hood, and air jet can be integrated in a single, movable unit. To assist the adhesion of the leading edge of the web to the core, an electrostatic charge, water, or an adhesive may be applied to the core prior to cutting the web to further ensure that the leading edge stays on the core during the first rotation after cutting. The adhesive should be a low tack type that does not interfere with cutting of the web and is easily removed from the core.

The deflector means preferably comprises a rigid kicker bar which is driven into the web by an inflatable bladder. The kicker and bladder can be movable so as to provide clearance for moving the core. A laterally movable paster roll is used to position the web near the core.

The method of operation of the apparatus for cutting and transferring a moving web onto a rotating core comprises the steps of positioning the web near the core; positioning a cutter blade near the web and near the core; positioning a web deflector means near the web on the opposite side from the cutter blade; driving the web deflector into the web to deflect the web into the cutting means thereby cutting the web; creating an air current in a channel between the core and a hood adjacent the cutter blade to pull a leading edge of the cut web into the channel and onto the core; and winding the web onto the core. The air current should be discontinued when the leading edge of the web passes the air jet. A means to adhere the web to the core can be applied to the core before the web is cut.

DESCRIPTION OF THE PREFERRED EMBODIMENT

Figure 1:
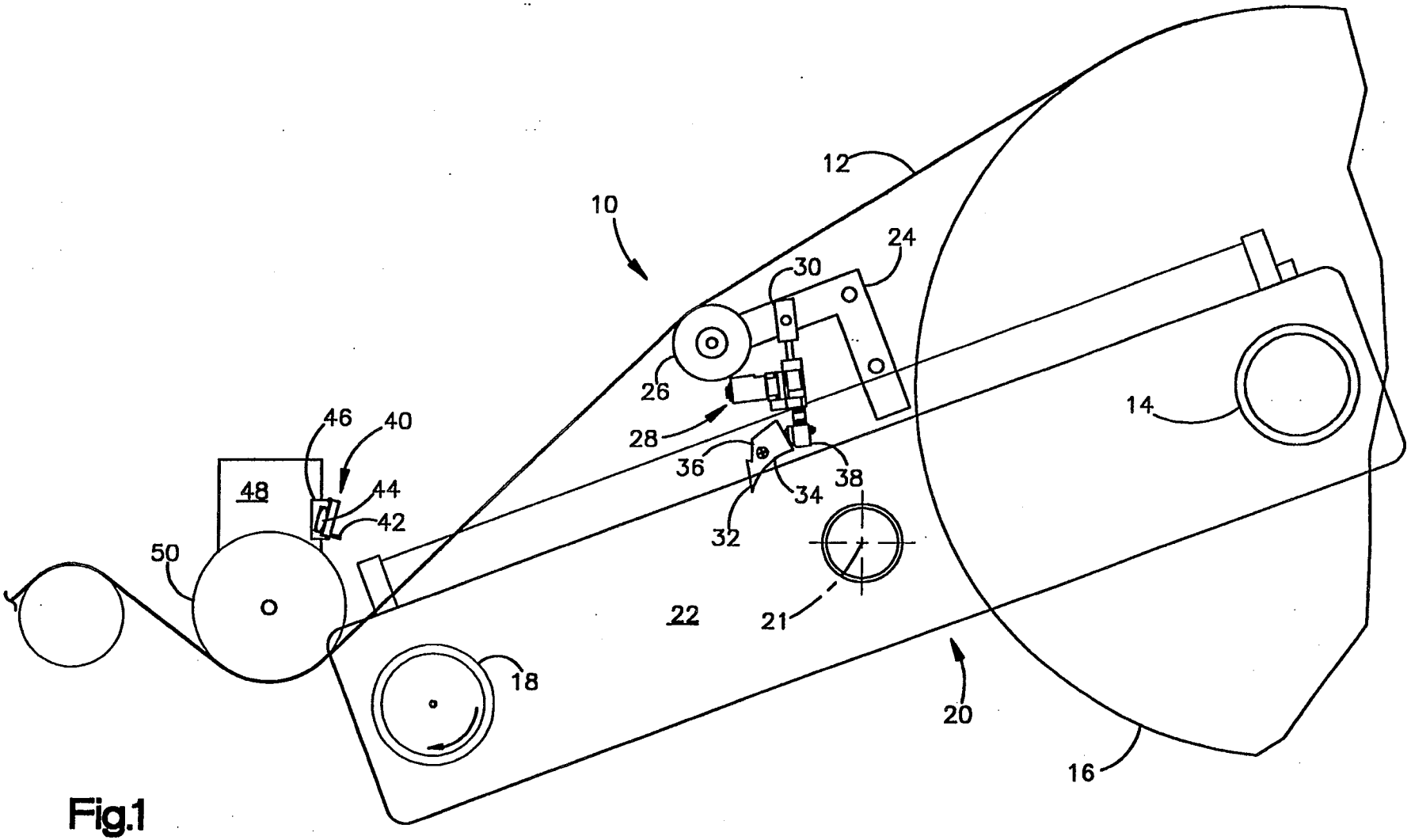
FIG. 1 shows a side, elevational view in section through the middle of a web winder according to the invention.

Referring to FIG. 1, operative parts of a winder 10 are shown. A web 12 is being wound onto a rotating core 14 which, as shown, has nearly formed a full roll 16 of the web. The speed of the web 12 can exceed 1000 feet per minute. When the roll 16 is full, the web 12 is transferred to a new core 18 to form a new roll. The cores 14, 18 are of a known type such as treated paper, metal or plastic. The rotating core 14 and the new core 18 are mounted on a rotatable turret 20 which rotates about an axis 21 to position the cores at desired locations for the transfer operation and for unloading the full roll 16 of the web. The turret 20 has opposing arms 22 (one shown) which carry the cores 14, 18 therebetween. The turret 20 shown carries two cores 14, 18, however, the turret could carry any number of cores. Alternatively, cores can be carried by means other than a turret, such as separate arm assemblies.

A movable carriage 24 extends between the turret arms 22 for guided movement along the arms 22. A guide roller 26 is mounted on the carriage and extends generally between the arms 22 to guide the web 12 to the roll 16. A blade assembly 28 is also mounted on the carriage 24 by a blade cylinder 30 which effects extension and retraction of the blade assembly 28. The blade assembly 28 includes a cutting means such as a cutter blade 32. The blade 32 is preferably a thin metal strip having a sharpened, serrated edge, as is known in the art. The blade assembly also includes a hood 34. The hood 34 comprises a curved surface which generally conforms to the new core 18. Preferably the hood 34 is located immediately adjacent the blade 32 and can be formed in a block 36 on which the blade is mounted. The block 36 may be pivotally mounted so that the blade 32 and hood 34 are angularly adjustable relative to the web 12 and the new core 18.

The hood 34 defines a channel 52 on the side adjacent the core. An air jet 38 is mounted on the blade assembly 28 to induce an air current in the channel, as discussed in detail below. As seen most clearly in FIG. 5, the air jet includes a thin nozzle 37 extending along the length of the core 18. The nozzle 37 is directed generally downwardly toward the core. The air jet is provided with a smooth surface 39 adjacent the nozzle 37 which curves away from the nozzle until it is generally tangent to the core 18. In practice, the best results have been achieved where the smooth surface 39 is slightly less than tangent to the core 18. That is, the surfce 39 is angled slightly toward the core.

Returning to FIG. 1, a web deflector means 40 is located on the opposite side of the web 12 from the blade assembly 28. The web deflector comprises a kicker 42 and a means move the kicker such as an inflatable bladder 44. The kicker 42 comprises an elongated rigid bar having an L-shaped cross-section. The kicker is pivotally mounted at its top to a relatively stationary deflector block 46. The bladder 44 is disposed between the block 46 and the kicker 42. The deflector block 46 is mounted on a movable paster assembly 48 which also has a rotatable paster roll 50 mounted thereon. The web travels over the paster roll 50 which is used in concert with the guide roll 26 to position the web for transfer. Alternatively, the web deflector may comprise a kicker which is stationary relative to the paster roll 50 and moves with the paster roll to deflect the web as the paster roll moves the web against the core 18. Yet another embodiment would use an air blast directed toward the web from opposite the blade 32. The air blast would deflect the web into the blade.

In operation, the web 12 passes under the paster roller 50 and over the guide roller 26 and is wound on the core 14 to form a roll 16. When the roll 16 nears completion, the carriage 24 is moved toward the new core 18 and the turret 20 is rotated clockwise. The new core 18 is rotated to match the speed of the web 12.

Figure 2:
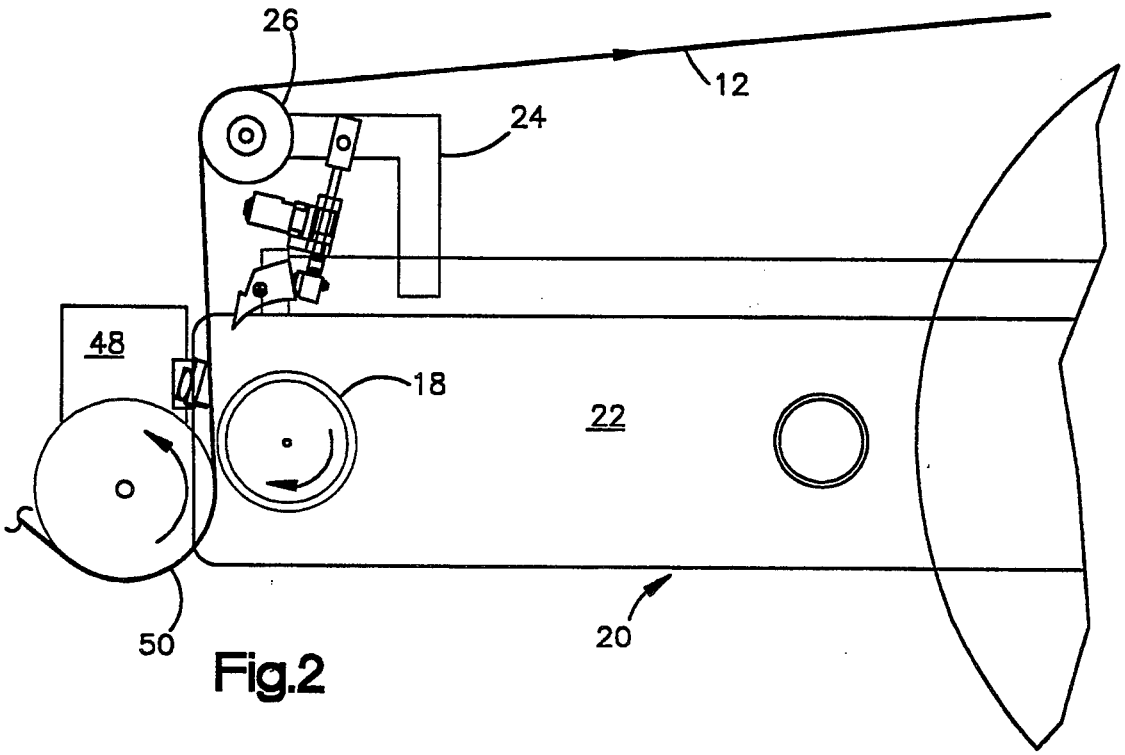
FIGS. 2 through 4 show the winder of FIG. 1 at different steps of a web transfer operation.

As shown in FIG. 2, the turret 20 is indexed by known means to a horizontal position so that the new core 18 is adjacent the paster assembly 48. The carriage 24 is at the left end of the turret arms 22 so that the web 12 moves substantially vertically from the paster roller 50 to the guide roller 26. There is approximately a one-half inch gap between the paster roller 50 and the new core 18.

Figure 3:
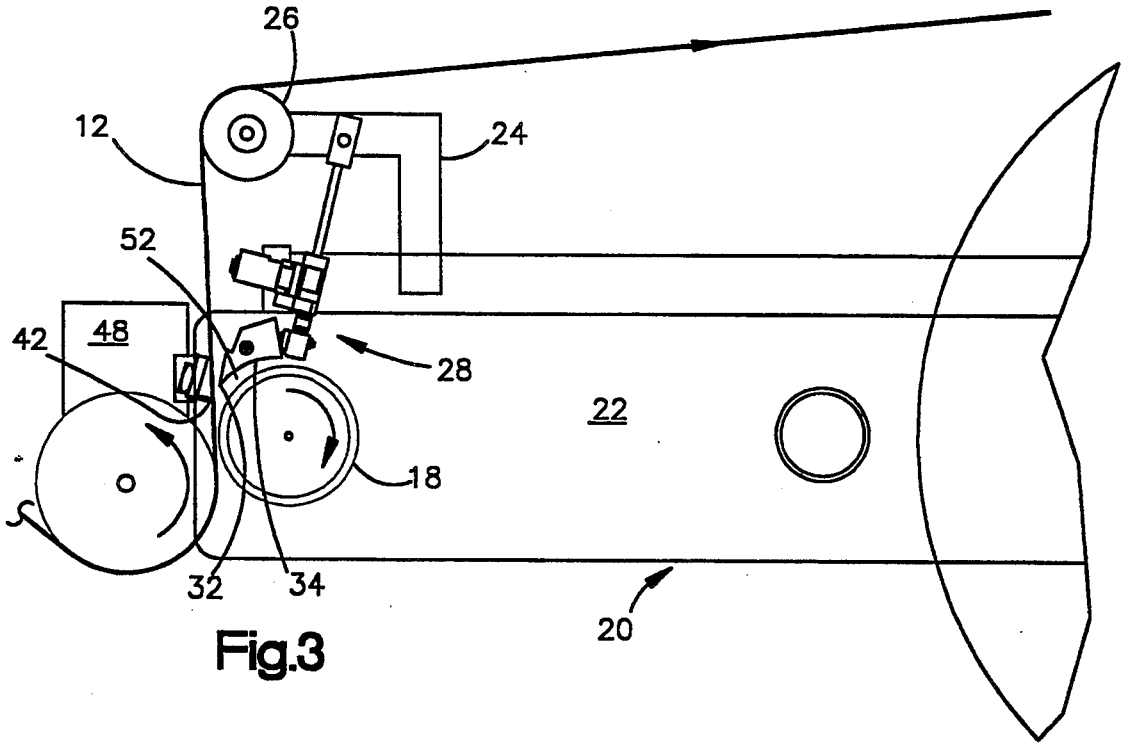

Referring to FIG. 3, the blade assembly 28 is extended toward the new core 18 and the web 12. The blade assembly is positioned so that the blade 32 is opposite the kicker 42, and a channel 52 is formed between the hood 34 and the new core 18. The blade 32 and hood 34 should be spaced from the core to allow for a slightly eccentric core and the channel 52 preferably tapers in a direction moving away from the blade. For example, the hood can be spaced 7/16 inches from the core near the blade and 3/32 inches near the air jet.

Figure 4:
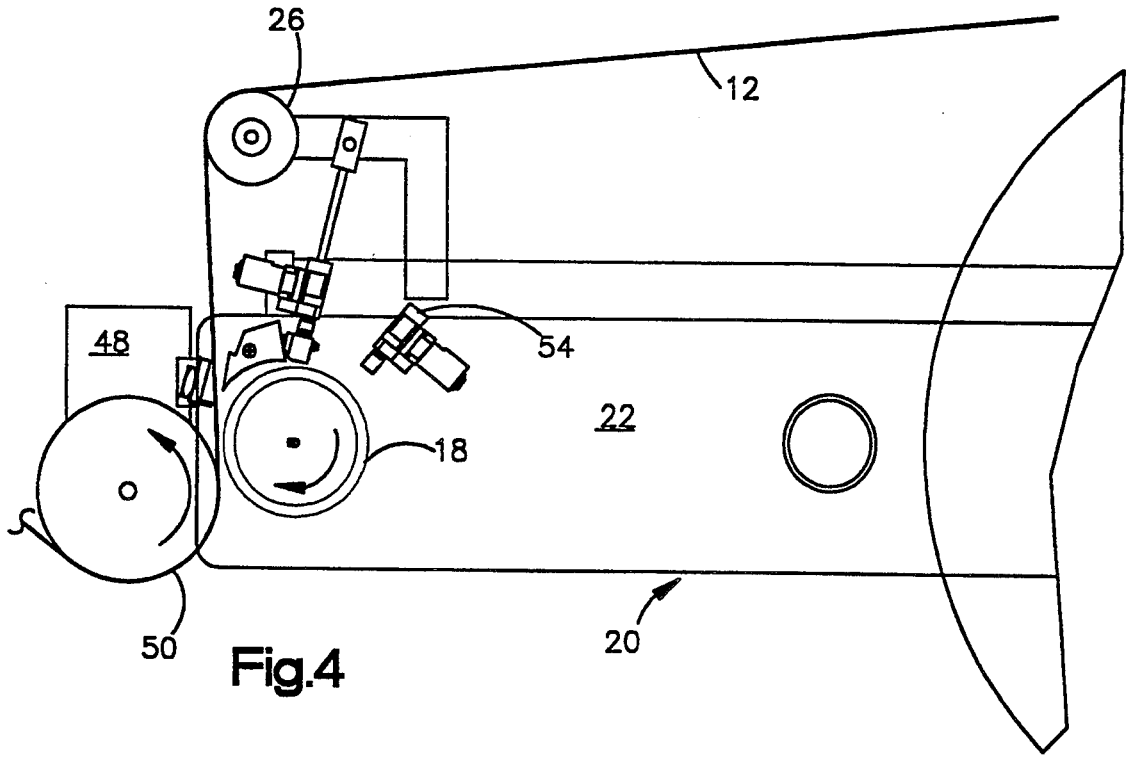

Referring to FIG. 4, a means to adhere the web 12 to the new core 18 is applied to the new core. A low tack adhesive such as water or glue can be sprayed on the new core by a sprayer 54 or a static charge can be applied to the core 18. A suitable adhesive is 3M Company's A-95 removable adhesive, which has an adhesion to steel of 3 oz./in. Because the adhesive is low tack, it is easily stripped from the core 18 so that the core can be reused.

Figure 5:
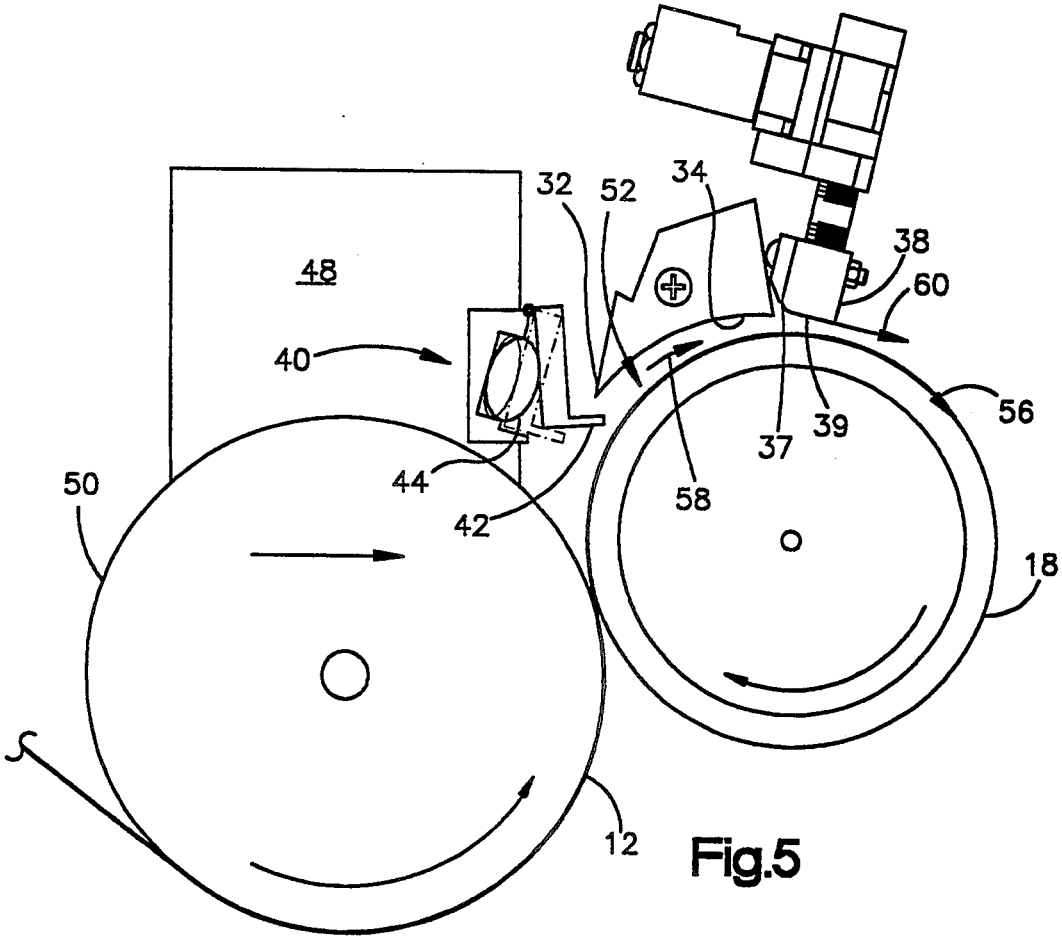
FIG. 5 shows an enlarged detail view of a cutting and transfer mechanism according to the invention.

As shown in FIG. 5, the paster assembly 48 moves laterally so that the paster roller 50 positions the web 12 against the new core 18. The adhesive, if used, should not create a strong bond with the web because after the web passes between the paster roller 50 and the core 18, it peels away from the core and continues upwardly to the guide roller 26. Adhesive can be applied around the entire circumference of the new core 18 without adversely affecting operation of the winder because the adhesive does not substantially bend the web. Preferably, adhesive should be applied only along a strip where a leading edge of the web will adhere after it is cut in order to save adhesive.

When the paster assembly 48 moves the paster roller 50 into position against the core 18, the paster assembly also moves the deflector 40 into position near the web 12 and opposite the blade 32. Vibration caused by movement of the deflector 40 and paster roller 50 should be allowed to dissipate, which should occur after less than one rotation of the new core 18, but may take longer at high web speeds. After the deflector 40 is settled in position, the bladder 44 is inflated to drive the kicker 42 into the web immediately below the blade 32 thereby cutting the web 12 on the blade 32 and deflecting a leading edge 56 of the web 12 into the channel 52.

The air jet 38 is activated at about the same time as the kicker 42 to induce an air stream or current 58 over the surface of the core 18 in the channel 52. Compressed air 60 flows into a plenum chamber in the air jet and is then throttled through the nozzle 37. According to the Coanda effect, the air 60 adheres to the smooth surface 39 and flows generally tangentially to the core 18. Surrounding air is entrained to induce the air current 58 through the channel. Because the channel 52 is tapered, the air current 58 tends to form nearly a laminar flow to smoothly urge the web through the channel. Such a preferred configuration reduces noise and increases airflow compared to air jets which use a hollow pipe having holes, for example.

By directing the air jet 38 away from the channel, the pressure in the channel 52 is reduced thereby pulling the leading edge 56 into the channel without contacting the hood 34. Because the hood 34 does not contact the web it need not be located immediately adjacent the core. Rather, the hood 34 should be spaced from the core 18 to avoid inadvertent contact with the web 12 and to allow for an out-of-round core. The air stream 58 created by the air jet 38 should have a velocity greater than the velocity of the web 12. The low pressure created by the air jet 38 evacuates air from between the web 12 and the core 18 to further aid movement of the web toward the core 18. Air moving through the tapered channel converges to a laminar flow stream which hugs the core. The air current tends to smooth the web as it pulls the web through the channel. As the leading edge 56 nears the air jet 38, the air jet urges the leading edge onto the core 18 where it lays flat on the core 18. The air jet 38 is discontinued as the leading edge approaches the point where the air stream 58 is no longer confined by the channel 52 and has a substantial angular wrap on the core 18. That is, the air jet is preferably discontinued before the leading edge of the cut web passes the nozzle 37.

The rotating core 18 continues to rotate to lay successive layers of web on top of the leading edge 56 to secure the web 12 on the core 18. The paster assembly 48 is withdrawn, the blade assembly 28 is retracted, and the carriage 24 slides back to a neutral position on the arms 22. The turret is rotated clockwise to a standard operating position to form a complete roll. When the roll is nearly full, the winder 10 is configured as shown in FIG. 1 and the web cutting and transfer sequence described above is repeated.

The present disclosure describes several embodiments of the invention, however, the invention is not limited to these embodiments. Other variations are contemplated to be within the spirit and scope of the invention and appended claims.

What is claimed is:

1. A web transfer apparatus for a web winder, comprising:

a rotatable core for winding a web thereon;

means for positioning the web near the core;

cutting means positionable near the web and near the core;

web deflector means positionable near the web on the opposite side from the cutting means for deflecting the web toward the core and into engagement with the cutting means thereby cutting the web;

a hood adjacent the cutting means and spaced from the core;

a channel defined by the core and the hood;

an air jet directed tangentially to the core and away from the channel to induce an air current in the channel to pull a leading edge of the web through the channel and onto the core.

2. A web transfer apparatus according to claim 1, wherein the air current means comprises a nozzle directed toward the core; and a smooth surface adjacent the nozzle and curving away from the nozzle to direct air generally tangentially to the core.

3. A web transfer apparatus according to claim 1, wherein air from the air jet travels at a greater velocity than the velocity of the web.

4. A web transfer apparatus according to claim 1, wherein the air jet is positioned adjacent a downstream end of the channel.

5. A web transfer apparatus according to claim 1, further comprising means to adhere the leading edge of the web to the core.

6. A web transfer apparatus according to claim 5, wherein the adhesive means is an electrostatic charge on the core.

7. A web transfer apparatus according to claim 5, wherein the adhesive means is water on the core.

8. A web transfer apparatus according to claim 5, wherein the adhesive means is glue on the core.

9. A web transfer apparatus according to claim 1, further comprising means to spray adhesive on the core.

10. A web transfer apparatus according to claim 1, wherein the deflector means comprises a rigid member pushed into the web by an inflatable bladder.

11. A web transfer apparatus according to claim 1, wherein the web positioning means comprises a laterally movable paster roll.

12. A web transfer apparatus for a web winder, comprising:

a rotatable core for winding a web thereon;

a transversely movable paster roll positionable to engage the web against the core;

cutting means positionable near the web and near the core;

web deflector means positionable near the web on the opposite side from the cutting means for deflecting the web toward the core and into engagement with the cutting means thereby cutting the web;

a hood adjacent the cutting means and spaced from the core;

a channel defined by the core and the hood;

an air jet positioned adjacent a downstream edge of the hood and directed tangentially to the core and away from the channel to induce an air current in the channel to urge a leading edge of the web through the channel and onto the core.

13. A method of transferring a moving web onto a rotating core, comprising the steps of:

positioning the web near the core;

positioning a cutting means near the web and near the core;

positioning a web deflector means near the web on the opposite side from the cutting means;

driving the web deflector into the web to deflect the web into the cutting means thereby cutting the web;

inducing an air current in a channel between the core and a hood adjacent the cutting means to pull a leading edge of the cut web into the channel and onto the core;

discontinuing the air current before the leading edge passes a source of the air current; and winding the web onto the core.

14. A method according to claim 13, wherein the air current is induced by air having a greater velocity than the velocity of the web.

15. A method according to claim 13, further comprising the step of providing the core with a means to adhere to the leading edge of the cut web prior to cutting the web.

16. A method according to claim 13, further comprising the step of driving the web into the core prior to cutting the web.

17. A method according to claim 13, further comprising the step of moving the cutting means and deflector means away from the core after the web is cut.

18. A method of transferring a moving web onto a rotating core, comprising the steps of:

positioning the web near the core;

positioning a cutting means near the web and near the core;

positioning a web deflector means near the web on the opposite side from the cutting means;

driving the web deflector into the web to deflect the web into the cutting means thereby cutting the web;

directing an air jet tangentially to the core and away from a channel between the core and a hood adjacent the cutting means to induce an air current in the channel to pull a leading edge of the cut web into the channel and onto the core; and winding the web onto the core.

19. A method of transferring a moving web onto a rotating core, comprising the steps of:

positioning the web near the core;

positioning a cutting means near the web and near the core;

cutting the web with the cutting means;

directing an air jet tangentially to the core and away from a channel between the core and a hood adjacent the cutting means to induce an air current in the channel to pull a leading edge of the cut web into the channel and onto the core; and winding the web onto the core.

20. A method of transferring a moving web onto a rotating core, comprising the steps of:

positioning the web near the core;

positioning a cutting means near the web and near the core;

cutting the web with the cutting means;

inducing an air current in a channel between the core and a hood adjacent the cutting means to pull a leading edge of the cut web into the channel and onto the core;

discontinuing the air current before the leading edge passes a source of the air current; and winding the web onto the core.

21. A web transfer apparatus for a web winder, comprising:

a rotatable core for winding a web thereon;

means for positioning the web near the core;

cutting means positionable near the web and near the core for cutting the web;

a hood adjacent the cutting means and spaced from the core;

a channel defined by the core and the hood;

an air jet directed tangentially to the core and away from the channel to induce an air current in the channel to pull a leading edge of the web through the channel and onto the core.

22. A web transfer apparatus according to claim 21, wherein the air jet is disposed on the hood adjacent a downstream end of the channel.

* * * * *